US005845223A

United States Patent [19]

Song

[11] Patent Number: 5,845,223

[45] Date of Patent: Dec. 1, 1998

[54] APPARATUS AND METHOD FOR CONTROLLING ACTUATORS OF HYDRAULIC CONSTRUCTION EQUIPMENT

[75] Inventor: Myung-Hoon Song, Suwon, Rep. of Korea

[73] Assignee: Samsung Heavy Industry Co., Ltd., Rep. of Korea

[21] Appl. No.: 946,714

[22] Filed: Oct. 8, 1997

Related U.S. Application Data

[63] Continuation-in-part of Ser. No. 241,752, May 12, 1994, abandoned.

[30] Foreign Application Priority Data

Jul. 2, 1993 [KR] Rep. of Korea ..... 1993-12456

[51] Int. Cl.[6] ..... G05B 13/00

[52] U.S. Cl. ..... 701/50; 37/234

[58] Field of Search ..... 701/50; 172/2; 37/234–236; 414/699, 708

[56] References Cited

U.S. PATENT DOCUMENTS

| | | | |
|---|---|---|---|
| 5,065,326 | 11/1991 | Sahm | 364/424.07 |
| 5,170,342 | 12/1992 | Nakamura et al. | 364/424.07 X |
| 5,189,605 | 2/1993 | Zuehlke et al. | 364/424.07 X |
| 5,347,448 | 9/1994 | Nam | 364/424.07 X |
| 5,359,517 | 10/1994 | Moriya et al. | 364/424.07 |
| 5,361,211 | 11/1994 | Lee et al. | 364/424.07 |

*Primary Examiner*—Michael Zanelli
*Assistant Examiner*—Edward Pipala
*Attorney, Agent, or Firm*—Lieberman & Nowak, LLP

[57] ABSTRACT

An apparatus and a method for controlling a moving speed of each bucket and a moving speed ratio between each bucket, to be proportional to a degree of operation of each operation indicator and an operation ratio between each operation indicator, regardless of changes in various working conditions or load pressures. The apparatus receives an operation command from an input portion and converts the operation command into an operation signal, calculates a required discharge oil amount of a pump, which is proportional to the operation signal and a required moving speed of an actuator and which is proportional to the degree of operation and the operation ratio of the operation signal, adjusts the required discharge oil amount and the required moving speed based on a maximum dischargeable oil amount of the pump, subtracts a real discharge oil amount and a real moving speed from the adjusted discharge oil amount and the adjusted moving speed, and controls the discharge oil amount of the pump according to the control signal from the subtraction, and controls the moving speed of the actuator according to the subtraction control signal.

10 Claims, 6 Drawing Sheets

APPARATUS AND METHOD FOR CONTROLLING ACTUATORS OF HYDRAULIC CONSTRUCTION EQUIPMENT

RELATED APPLICATIONS

This application is a continuation-in-part of U.S. patent application Ser. No. 08/241,752 filed May 12, 1994 now abandoned.

BACKGROUND OF THE INVENTION

1. Field of the Invention

The present invention relates to an apparatus and a method for controlling hydraulic construction equipment, and more particularly to an apparatus and a method for controlling a moving speed of each bucket and a moving speed ratio between each bucket to be proportional to a degree of operation of each operation indicator and an operation ratio between each operation indicator regardless of changes in various working conditions or load pressures.

2. Description of the Prior Art

Generally, hydraulic construction equipment such as excavators, loaders and dozers have the buckets moved by using a plurality of variable displacement pumps and a plurality of hydraulic cylinders, and these buckets are operated by various operation indicators such as joystick, pedal, lever, etc.

The design of such equipment is attempted so that the moving speed of each bucket and the moving speed ratio between each bucket can be proportional to the degree of operation of each operation indicator and the operation ratio between each operation indicator, and the oil amount supplied from the pump is proportional to the degree of operation of each operation indicator in order to produce the moving speed required by each bucket.

However, since the pump has a limit value of the mechanical maximum discharge amount of oil, and the load pressure varies depending on the working conditions such as excavation, dumping and ground leveling, there have been problems that the sum of the oil amounts required to produce the moving speed of the bucket corresponding to the degree of operation required by the operation indicator often exceeds the maximum dischargeable amount of oil for a given load pressure. Moreover, in case of the combined moving of the buckets, the actual speed ratio of each bucket does not accurately correspond to the operation ratio of the operation indicator.

In other words, since the moving speed of each bucket and the moving speed ratio between of each bucket are not accurately proportional to the degree of operation of each operation indicator and the operation ratio between each operation indicator, there has been drawback of lowering the work efficiency.

SUMMARY OF THE INVENTION

It is an object of the present invention to provide an apparatus and a method for controlling a moving speed of each bucket and a moving speed ratio between each bucket to be accurately proportional to a degree of operation of each operation indicator and an operation ratio between each operation indicator regardless of changes in various working conditions and load pressures in a hydraulic construction equipment.

According to one aspect of the present invention, there is provided an apparatus for controlling hydraulic construction equipment, comprising: means for receiving an operation command from an input portion and converting said operation command into an operation signal; means for calculating a required discharge oil amount of a pump which is proportional to said operation signal and a required moving speed of an actuator which is proportional to the degree of operation and the operation ratio of said operation signal; means for adjusting said required discharge oil amount and said required moving speed based on a maximum dischargeable oil amount of said pump; means for subtracting a real discharge oil amount and a real moving speed from said adjusted discharge oil amount and said adjusted moving speed; means for controlling the discharge oil amount of said pump according to the control signal from said subtracting means; and means for controlling the moving speed of said actuator according to the control signal from said substracting means.

According to another aspect of the present invention, there is provided a method for controlling a hydraulic construction equipment, comprising the steps of: (1) calculating a necessary discharge oil amount required for the moving of actuators according to a reference input signal for controlling an oil amount of pumps with a left-hand and a right-hand sides, another reference input signal for controlling a moving speed of said actuators, and maximum dischargeable oil amount signal of said pumps; (2) determining a required discharge oil amount for the left-hand side pump according to a comparison between a sum of a necessary oil amounts required for the moving of the actuators corresponding to the left-hand side pump and a maximum dischargeable oil amount of the left-hand side pump; (3) determining a required discharge oil amount for the right-hand side pump according to a comparison between a sum of a necessary oil amounts required for the moving of the actuators corresponding to the right-hand side pump and a maximum dischargeable oil amount of the right-hand side pump; and (4) generating a reference input signal for controlling the oil amount of said pumps and another reference input signal for controlling the moving speed of said actuators according to said required discharge oil amounts of said second and third steps.

BRIEF DESCRIPTION OF THE DRAWINGS

FIG. 6(*b*) is a diagram illustrating the calculation of Qmax, left/right as detected by pressure detectors in the case where oil amount mixedly flow through the proportion valves.

FIG. 7(*b*) is a diagram illustrating the inner structure of the boom cylinder.

DETAILED DESCRIPTION OF THE PREFERRED EMBODIMENTS

In the following, the present invention will be described in detail with reference to the accompanying drawings.

Figure 1:
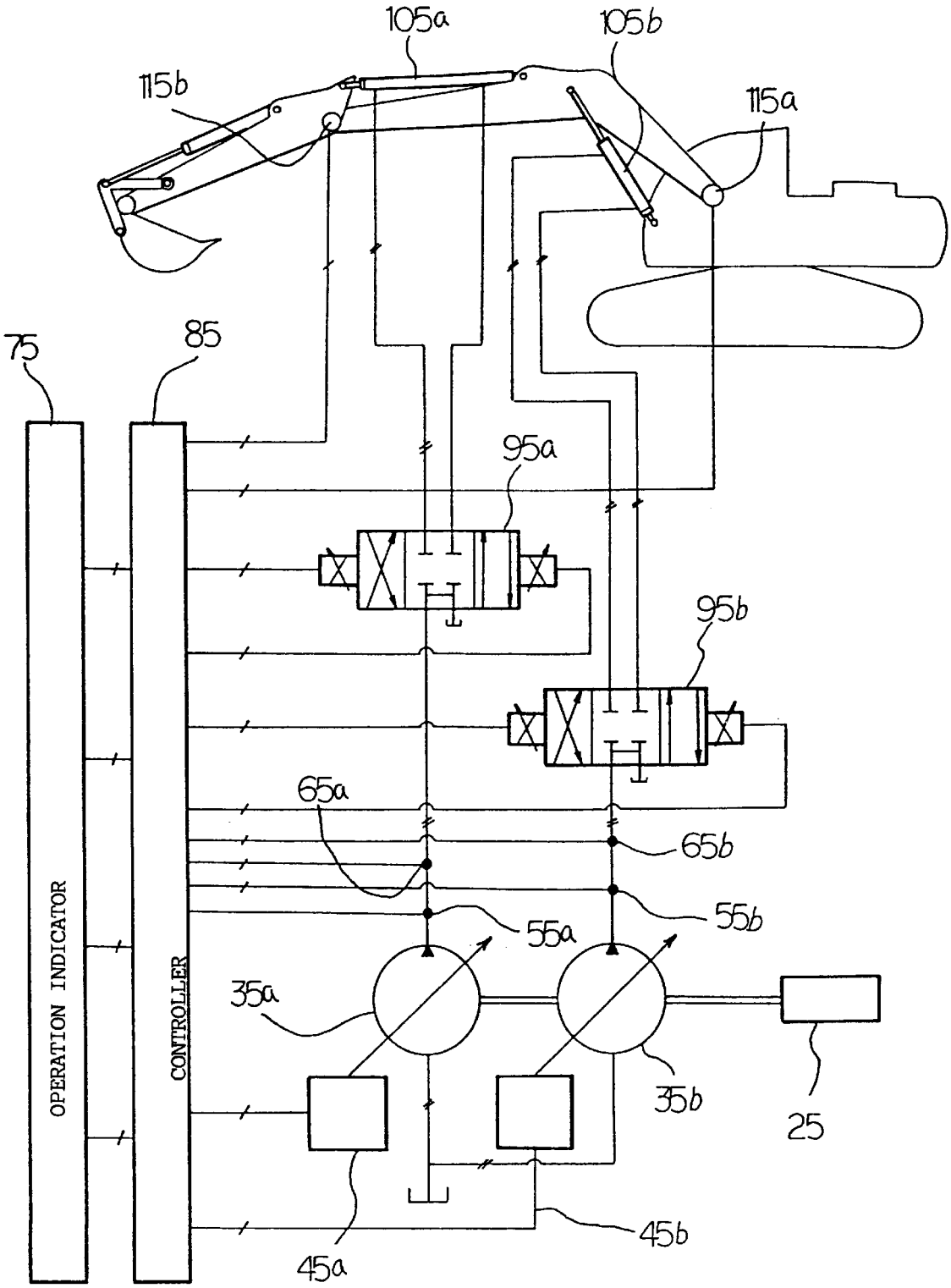
FIG. 1 is a schematic hydraulic circuit diagram illustrating an overall hydraulic system of an excavator

FIG. 1 is a schematic hydraulic circuit diagram illustrating an overall hydraulic system of an excavator which represents one of the typical hydraulic construction equipment.

As shown in FIG. 1, the hydraulic system of the present invention has an engine 25 as a power source, a first and a second variable displacement pumps 35*a*, 35*b* operated by the engine 25, a first and a second pump regulation valves 45*a*, 45*b* for controlling the discharge oil of the first and second pumps 35*a*, 35*b* respectively, a first and a second pressure detectors 55*a*, 55*b* for detecting the discharge pressures from the first and the second pumps 35*a*, 35*b*, a first and a second oil amount detectors 65*a*, 65*b* for detecting the discharge oil amounts from the first and the second pumps 35*a*, 35*b*, and operation indicator 75 of the buckets using a switch or a touch sensor, a controller 85 containing a microcomputer for controlling the overall operation by receiving the input signal from the operation indicator, a first and a second solenoid controlled proportion valves 95*a*, 95*b* for controlling the oil amount by receiving the electrical signals from the controller 85, a dipper stick cylinder 105*a* for actuating the dipper stick of the excavator, a boom cylinder 105*b* for actuating the boom of the excavator, a boom speed detector 115*a* located at the joint part of the upper frame of the excavator and the boom, and a dipper stick speed detector 115*b* located at the joint part of the boom and the dipper stick.

In the following, the operation of the hydraulic construction equipment in the above will be described.

Based on the degree of operation put in through the operation indicator 75, and the data detected from the dipper stick speed detector 115*b* and the boom speed detector 115*a*, the signal values are calculated by the controller 85. Once the engine 25 is operated by the calculated signal values, the first and the second pump regulation valves 45*a*, 45*b* control the first and the second variable displacement pumps 35*a*, 35*b* to supply the sum of the oil amounts proportional to the degree of operation given by the operation indicator 75, and the first and the second solenoid controlled proportion valves 95*a*, 95*b* control the oil amounts supplied to the dipper stick cylinder 105*a* and the boom cylinder 105*b* to be proportional to the degree of operation and the operation ratio given by the operation indicator 75.

Figure 2:
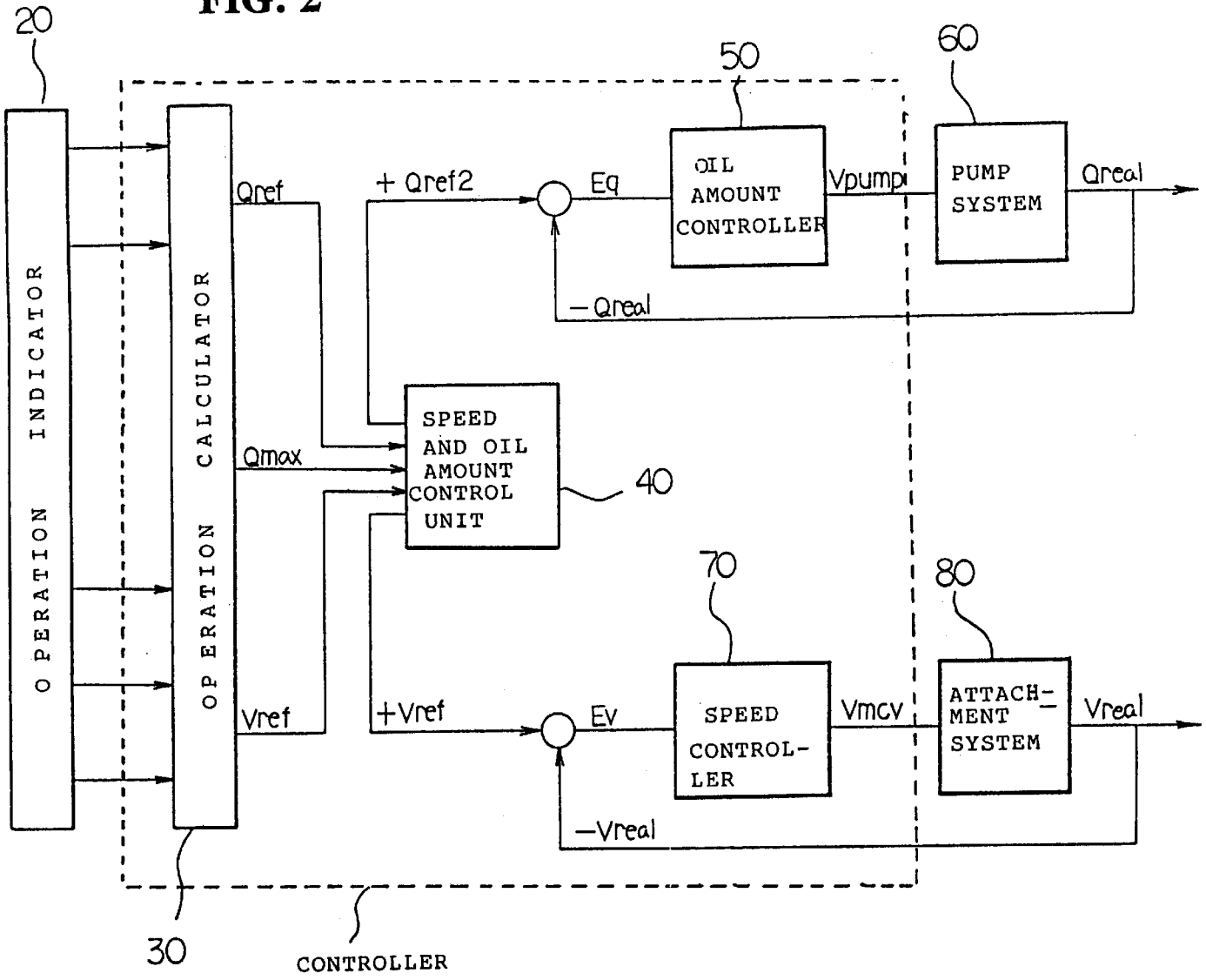
FIG. 2 is a block diagram of the control unit of the present invention

FIG. 2 represents the block diagram of the controller of the present invention.

After the operation signals given by the operation indicator 20, such as electric joystick, pedal or other actuating devices, are detected by an operation calculator 30, the required discharge amount of oil proportional to the degree of operation, i.e., the reference input signal Qref for controlling the oil amount of the pump, the required moving speed of the bucket proportional to the degree of operation and the operation ratio of the operation signals, i.e., the reference input signal Vref for controlling the moving speed of the bucket, and the maximum dischargeable oil amount signals Qmax detected by the first and the second pressure detectors 55*a*, 55*b* are calculated. Signals from operation indicator 20 to the calculator 30 represent electric actuating signals from the operation indicator 20.

Figure 4:
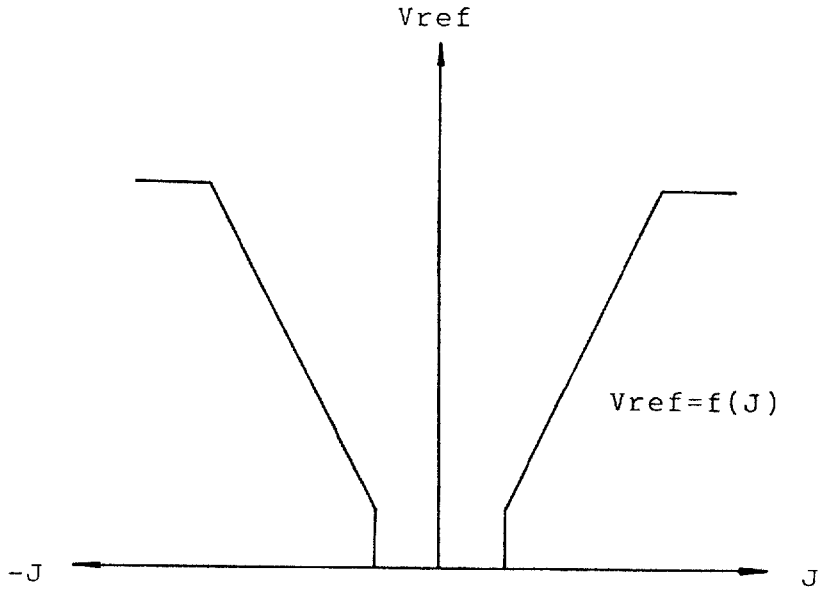
FIG. 4 is a diagram illustrating the calculation of Vref of the actuating device as being set proportional to the actuating amount of the operation indicator signals.

Specifically, the required speed Vref of the actuating device is set to be proportional to the direction of the actuating amount signal "J" detected by the operation indicator 20 and represented by the horizontal axis, as shown in FIG. 4. This means that the required speed of the actuating device is increased in proportion to the level of the actuating signal of the operation indicator 20. This also means that the level of the actuating signal of the operation indicator 20 is high as the required speed of the actuating device is increased. That is, the Vref calculation in the operation calculator 30 is determined by a function Vref=f(J) proportional to the signal of the operation indicator 20 as shown in FIG. 4.

Figure 5:
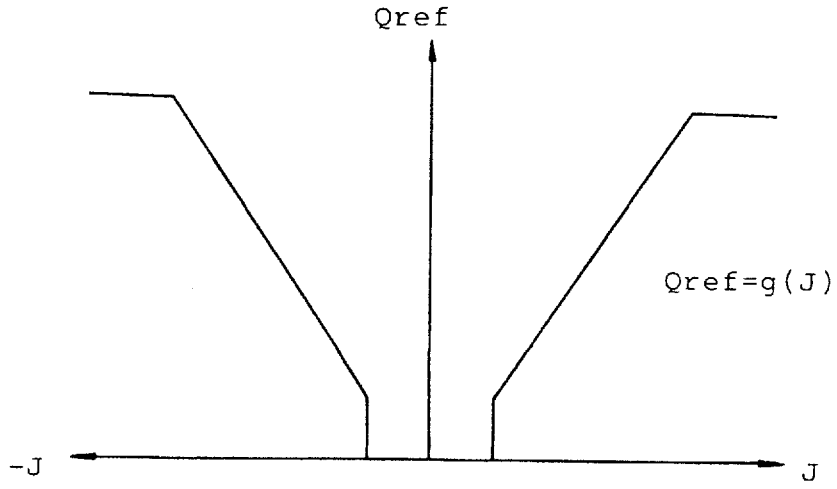
FIG. 5 is a diagram illustrating the calculation of Qref of the actuating device as being set proportional to the actuating amount of the operation indicator signals.

As shown in FIG. 5, the required discharge oil amount Qref of the pump is set to be proportional to the actuating amount J of the operation indicator 20. This means that the required speed Vref of the actuating device is increased in proportion to the level of the actuating signal, and accordingly, the required discharge oil amount Qref is increased as the level of the actuating signal is increased as shown in FIG. 5. The required speed Vref of the actuating device is reduced as the level of the actuating signal of the operation indicator is low, and accordingly the required discharge oil amount Qref is decreased. The Qref calculation in the operation calculator 30 is determined by a function Qref=g(J) proportional to the signal of the operation indicator 20.

Figure 6A:
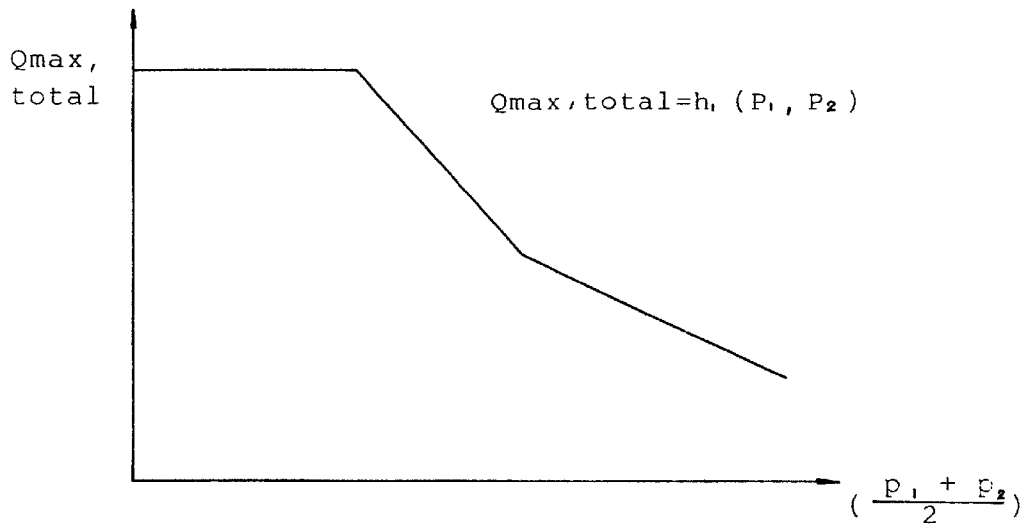
FIG. 6(*a*) is a diagram illustrating the calculation of Qmax, total as detected by pressure detectors in the case where oil amount individually flow through the proportion valves.
Figure 6B:
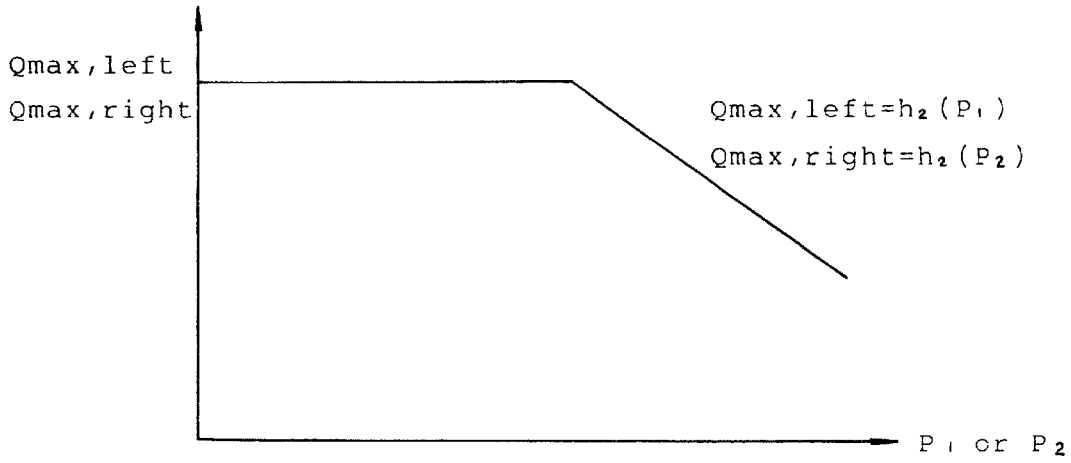

As shown in FIGS. 6(*a*) and 6(*b*), the maximum discharge oil amount signals Qmax is calculated according to the pressures $p_1$ and $p_2$ as detected by pressure detectors 55*a* and 55*b*. Specifically, Qmax is calculated in two cases: 1) In the case shown in FIG. 6(*a*), Qmax, total is determined as a function of the combined oil amount flow from the variable displacement pump 35*a* and 35*b* through the solenoid controlled proportion valves 95*a* and 95*b* to the cylinders 105*a* and 105*b* to drive the actuating device; and 2) In the case shown in FIG. 6(*b*), Qmax, left(right) is determined as a function of the individual oil amount flow from the variable displacement pumps 35*a* (35*b*) flow through the solenoid controlled proportion valves 95*a* (95*b*) to the cylinders 105*a*(105*b*) to drive the actuating device.

Then, based on the reference input signal Qref for controlling the oil amount of the pump, the reference input signal Vref for controlling the moving speed of the bucket, and the maximum dischargeable oil amount signal Qmax, a speed and oil amount control unit 40 adjusts the reference input signals Qref and Vref to+Qre2 and+Vref respectively, and sends these adjusted input signals to an oil amount controller 50 and a speed controller 70.

The oil amount controller 50 performs the calculation for controlling the discharge amount of the pump based on the reference input signal+Qref2 and the real discharge oil amount signal Qreal with an error(Eq) detected from the oil amount detectors 65*a*, 65*b* shown in FIG. 1, and sends out an oil amount control signal Vpump to the first and the second pump regulation valves 45*a*, 45*b* of the pump system comprising pumps 35*a*, 35*b* indicated as block 60 in FIG. 2.

On the other hand, the speed controller 70 performs the calculation for controlling the moving speed of the bucket based on the reference input signal+Vref2 and the real moving speed Vreal with an error Ev detected from the boom speed detector 115*a* and the dipper stick speed detector 115*b* shown in FIG. 1, and sends out a speed control signal Vmcv to the first and the second solenoid controlled proportion valves 95*a*, 95*b* for controlling the cylinders 105*a,b* and boom and dipper stick of the actuator system 80 as indicated in FIG. 2.

Figure 3:
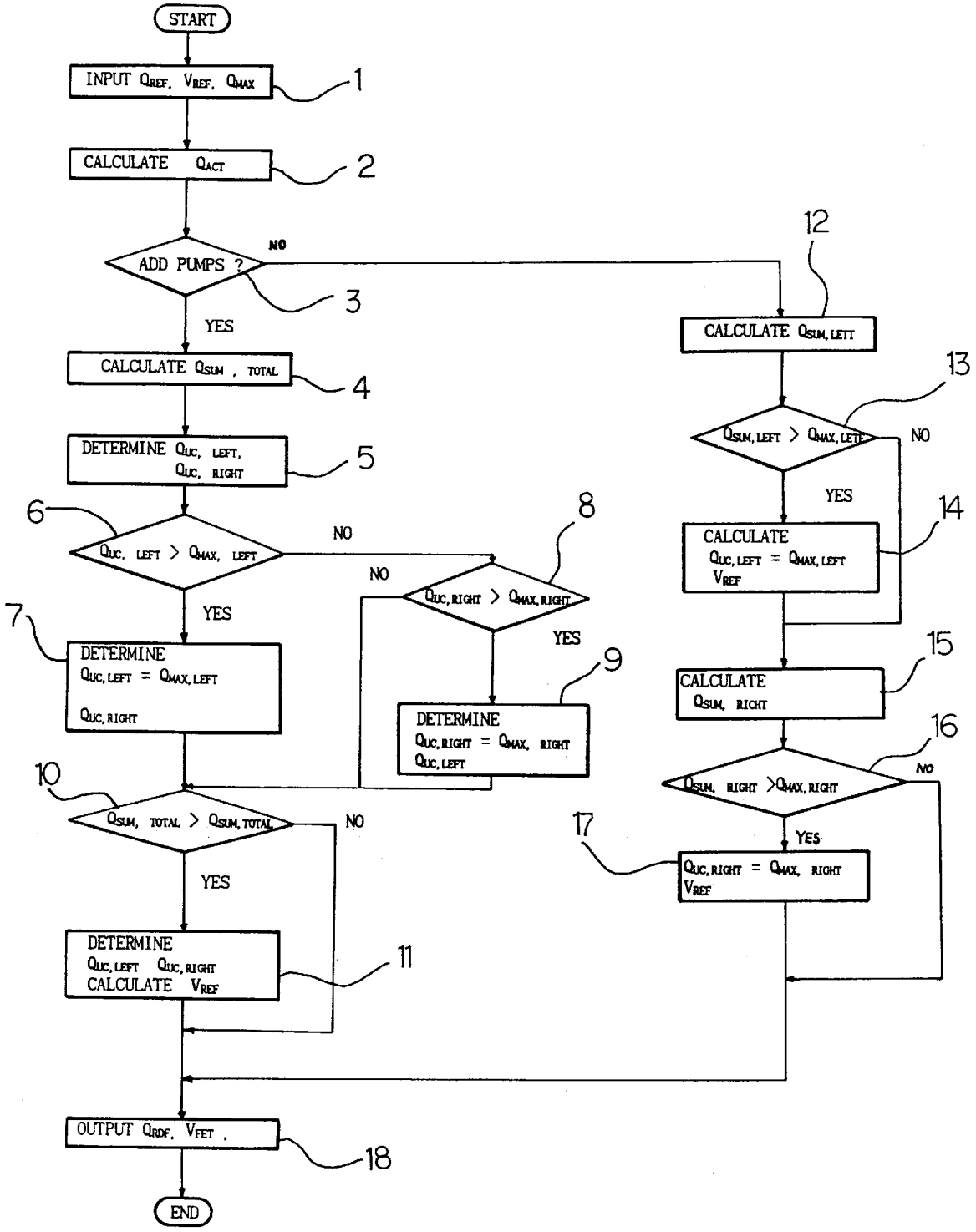
FIG. 3 is a flow diagram of the control unit of the present invention

The operation of the control unit 40 will be described in more detail with reference to the flow diagram shown in FIG. 3.

The operation calculator 30, according to the operation signal given by the operation indicator 20, produces the reference input signal Qref for controlling the oil amount proportional to the degree of operation, the reference input signal Vref for controlling the moving speed proportional to the degree of operation and the operation ratio, and the maximum dischargeable oil amount signal Qmax (step 1).

Figure 7A:
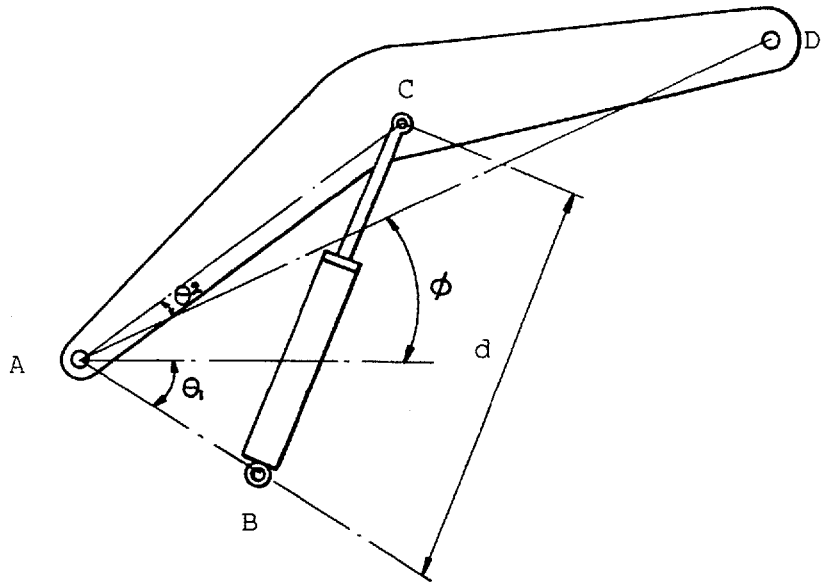
FIG. 7(*a*) is a diagram illustrating the length "d" of the boom cylinder as calculated by the signal generated by the boom angle detector.
Figure 7B:
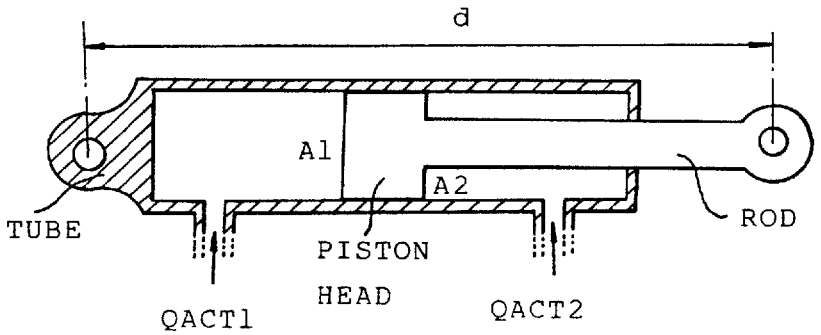

The necessary oil amount $Q_{ACT}$ required for the actuation of each bucket is calculated by the reference input signal Vref for controlling the moving speed through well-known calculation process(step 2). Specifically, the calculation of $Q_{ACT}$ based on Vref is shown by way of the following example of the "boom" driven by the boom cylinder 105*b* as shown in FIG. 1. As shown in FIG. 7(*a*), the length "d" of the boom cylinder 105*a* is calculated by the signal representing the angle "ϕ" detected from the boom angle detector 115*a* as set forth in equation 1) as follows:

$$d=L_{AC}^2+L_{AB}^2-2AB\ L_{AC}COS\ (\phi+\theta 1\theta 2) \quad (1)$$

wherein $L_{AC}$, $L_{AB}$, θ1 and θ2 represent the fixed values regardless of the time determined by the boom structure. From this, a second calculation is made as set forth in equation 2):

$$d'=\phi'(L_{AC}L_{AB}\sin(\phi)/\ d) \quad (2)$$

wherein d' represents a change ratio of the length per hour of the boom cylinder, and ϕ' represents a boom speed signal from the boom speed detector 115*a*. A third calculation is then made as follows:

δϕ=ϕ' δt, wherein δt represents an hour of time, and δϕ represents the change amount of the boom angle signal.

FIG. 7(*b*) shows an inner structure of boom cylinder 105*b* of FIG. 1. The term d', i.e., the change ratio of a cylinder length d, is calculated in accordance with the oil amount to the cylinder $Q_{ACT}$ and the width of the piston inside the cylinder as set forth in equations 3a) and 3b) as follows:

$$\text{In case that the cylinder length is increased: } d'=Q_{ACT}1/A1 \quad (3a)$$

$$\text{In case that the cylinder length is decreased: } d'=Q_{ACT}2/A2 \quad (3b)$$

where A1 and A2 represent the width of the piston inside the cylinder as shown in FIG. 7(*b*). In equations 3a,b, the increase or decrease of the cylinder length is determined by the direction of the signal J detected from the operation indicator 20. From equations 3a,b, equations 4a,b, are readily determined, respectively, as follows:

$$Q_{ACT}=A1\ d' \quad (4a)$$

$$Q_{ACT}=A2\ d' \quad (4b)$$

Equation 4a) governs the case where the signal J from the operation indicator is in upward direction and equation 4b) governs the case that the signal J from the operation indicator is in downward direction.

As mentioned above, the required speed Vref is determined by Vref=f(J) as shown in FIG. 4. $V_{REF}$ is the same to the boom speed signal ϕ' from the boom speed detector, i.e., the real speed of rotation. Thus, $Q_{ACT}$=k(J,ϕ). The calculation of $Q_{ACT}$ from the above equations is performed in the speed and oil amount control unit 40 in FIG. 2.

After the required oil amounts are calculated from step 1 and step 2, it is determined whether or not the adding-up condition of pump can be satisfied(step 3).

Here, the adding-up condition of the pumps means that when more than one buckets are actuated in combination, the oil amounts discharged from more than one pumps are added up and supplied to any one of the buckets.

If the adding-up condition can be satisfied in step 3, the sum of the oil amounts Qsum, total that should be discharged from both pumps for the actuation of the bucket is calculated (step 4). The case of not satisfying the adding-up condition will be described later on.

The required discharge amount of the left-hand side pump Quc,left and the required discharge amount of the right hand side pump Quc,right are determined with each amount equal to the 50% of the sum of oil amounts Qsum,total calculated in step 4(step 5).

The required discharge amount of the left-hand side pump Quc,left is compared with the maximum dischargeable amount of the left-hand side pump Qmax,left(step 6). As a result of the comparison in step 6, if Quc,left is larger than Qmax,left, Quc,left is set to be equal to Qmax,left and the difference amount Quc,left−Qmax,left is added to the required discharge amount of the right-hand side pump(step 7).

The difference amount can be added to the required discharge amount of the right-hand side pump since the adding-up condition in step 3 has been satisfied. On the other hand, if the required discharge amount of the left-hand side pump is less than the maximum discharge amount of the right-hand side pump in step 6, the required discharge amount of the right-hand side pump Quc,right determined in step 5 is compared with the maximum discharge amount of the right-hand side pump Qmax,right(step 8).

If Quc,right is less than Qmax,right, the 10th step is continued. If the Quc,right is larger than Qmax,right, Quc, right is set to be equal to Qmax,right and the difference amount Quc,right−Qmax,right is added to the required discharge amount of left-hand side pump(step 9). Since the adding-up condition of step 3 has been satisfied, the difference amount can be added to the discharge amount of left-hand side pump.

After the required discharge amount of left-hand side and right-hand side pumps from steps 6 and 8, the sum of the required discharge amounts calculated in step 4 that should be discharged from both pumps for the actuation of buckets is compared with the sum of the maximum dischargeable amount of both pumps(i.e., the maximum dischargeable amounts of left-hand side pump+the maximum dischargeable amount of right-hand side pump)(step 10).

If the sum of the required discharge amounts that should be discharged from both pumps for the actuation of buckets are less than the sum of the maximum dischargeable amount of both pumps, then, since the further operation is not needed, the 18th step is continued where the reference signals are produced.

However, if the sum of the required discharge amounts that should be discharged from both pumps for the actuation of buckets are larger than the sum of the maximum dischargeable amounts of both pumps, the sum of the required discharge amount is set to be equal to the sum of the maximum dischargeable amounts. The, sum of the maximum dischargeable amount is distributed in the same proportions as those of the necessary discharge amounts required for the actuation of buckets in their respective moving directions which have been calculated in step 2, and based on the distributed amounts, the required moving speed of each bucket is calculated(step 11).

According to the calculated data, the reference signals for controlling the oil amount and the moving speed are produced respectively(step 18).

If the adding-up condition is not satisfied, the required discharge amount of left-hand side pump is calculated is the sum of the discharge amounts that should be discharged from the left-hand side pump for the actuation of buckets (step 12).

The sum of the discharge amounts that should be discharged from the left-hand side pump is compared with the maximum dischargeable amounts from the left-hand side pump(step 13).

As a result of the comparison in step 13, if the sum of the discharge amounts that should be discharged from the left-hand side pump is less than the maximum dischargeable amount from the left-hand side pump, the maximum dischargeable amount can be used and step 15 is continued since the determination of the required dischargeable amount of the left-hand side pump is not necessary.

However, if the sum of the required discharge amounts that should be discharged from the left-hand side pump is larger than the maximum dischargeable amount from the left-hand side pump, the sum of the required discharge amounts is set to be equal to the maximum dischargeable amount from the left-hand side pump. Then, the maximum dischargeable amount is distributed in the same proportions as those of the discharge amount from the left-hand side pump required for the actuation of each bucket in the respective moving directions, and based on the distributed discharge amounts, the required moving speed of each bucket using the left-hand side pump is calculated(step 14).

After the required discharge amount from the left-hand side pump and the calculation for buckets have been determined, the required discharge amounts from the right-hand side pump are calculated as the sum of the required discharge amounts that should be discharged from the right-hand side pump(step 15).

The calculated sum of the required discharge amounts that should be discharged from the right-hand side pump is compared with the maximum dischargeable amounts from the right-hand side pump(step 16).

As a result of this comparison, if the sum of the required discharge amounts that should be discharged from the right-hand side pump is less than the maximum dischargeable amount from the right-hand side pump, the 18th step is continued since the determinations of the required discharge amount of the right-hand side pump and the moving speeds of buckets are not necessary.

However, if the sum of the required discharge amounts from the right-hand side pump is larger than the maximum dischargeable amount from the pump, the sum of the required discharge amount is set to be equal to the maximum dischargeable amount from the right-hand side pump. Then, the maximum dischargeable amount is distributed in the same proportions as those of the discharge amounts from the right-hand side pump required for the actuation of each bucket in the respective moving directions, and based on the distributed discharge amounts, the required moving speed of each bucket using the right-hand side pump is calculated (step 17).

The reference input signal for controlling the oil amounts Qref and the reference input signal for controlling the moving speed Vref are calculated by the steps described in the above, and are sent to the oil amount controller 50 and the speed controller 70, respectively.

Specifically, as shown in FIG. 2, oil amount controller 50 sets the reference input signals ($Q_{REF2}$ output of step 18 in FIG. 3) for a plurality of pumps 35*a* and 35*b* (of FIG. 1) calculated in speed and oil amount control unit 40 to feedback the discharge oil amount $Q_{REAL}$ from the real amount of oil detected from oil amount detectors 65*a* and 65*b* of FIG. 1. Then, the controller 50 performs the calculation for controlling the discharge amount of the pump based on the difference "Eq" between reference input signal+$Q_{REF2}$ and the real discharge oil amount signal−$Q_{REAL}$. Specifically, the error signal "Eq" is used as the parameter to control the output Vpump to the regulation valves 45*a* and 45*b* of the pump.

Similarly, the speed controller block 70 in FIG. 2 sets the reference input signals for a plurality of solenoid controlled proportion valves 95*a* and 95*b* (of FIG. 1) in speed and oil amount control unit 50 to feedback the discharge oil amount $V_{REAL}$ of the real actuating speed detected from the boom speed detector and dipper stick speed detector 115*a* and 115*b* (FIG. 1). Then, the speed controller 70 performs the calcuation for controlling the actuating speed of the valve based on the difference Ev between reference input signal+$V_{REF}$2 and the real actuating speed−$V_{REAL}$. Specifically, the error signal "Eq" is used as the parameter to control the output Vmcv to the solenoid controlled proportion valves 95*a* and 95*b* in attachment system 80.

As described in the above, the present invention which can be applied in the hydraulic construction equipment has advantages of the work automation and efficiency by controlling optimally the moving speed of each bucket and the speed ratio between each bucket to be accurately proportional to the degree of operation of each operation indicator and the operation ratio between each operation indicator regardless of changes in working conditions and load pressures

What is claimed is:

1. A method for controlling actuators of hydraulic construction equipment, said actuators supplied with oil from pumps through electrically controllable proportion valves, each pump defined as having left and right hand sides, said method comprising the steps of:

(1) calculating a necessary discharge oil amount required for the moving of said actuators according to a first reference input signal for controlling an oil amount of said pumps, a second reference input signal for controlling a moving speed of said actuators, and maximum dischargeable oil amount signal of said pumps;

(2) determining a required discharge oil amount for the left-hand side of the pump according to a comparison between a sum of a necessary oil amounts required for the moving of the actuators corresponding to the left-hand side of the pump and a maximum dischargeable oil amount of the left-hand side of the pump;

(3) determining a required discharge oil amount f or the right-hand side of the pump according to a comparison between a sum of a necessary oil amounts required for the moving of the actuators corresponding to the right-hand side of the pump and a maximum dischargeable oil amount of the right-hand side of the pump;

(4) generating a third reference input signal for controlling the oil amount of said pumps and a fourth reference input signal for controlling the moving speed of said actuators according to said required discharge oil amounts of said second and third steps; and (5) controlling the oil amount of said pumps and the moving speed of said actuators by means of the third and fourth reference input signals generated in said fourth step being applied to said proportion valves.

2. The method of claim 1, wherein said second step comprises the steps of:

(1) comparing a required discharge oil amount of the left-hand side of the pump with a maximum dischargeable oil amount of the left-hand side of the pump; and (2) setting said required discharge oil amount to be said maximum dischargeable oil amount when said required discharge oil amount is larger than said maximum dischargeable oil amount.

3. The method of claim 1, wherein said third step comprises the steps of:

(1) comparing a required discharge oil amount of the right-hand side of the pump with a maximum dischargeable oil amount of the right-hand side of the pump; and (2) setting said required discharge oil amount to be said maximum dischargeable oil amount when said required discharge oil amount is larger then said maximum discharge able oil amount.

4. A method for controlling actuators of hydraulic construction equipment, said actuators supplied with oil from pumps through electrically controllable proportion valves, each pump defined as having left and right hand sides, said method comprising the steps of:

(1) calculating a necessary discharge oil amount required for the moving of actuators moved in a combination way according to a first reference input signal for controlling an oil amount of pumps with a left-hand and right-hand sides, a second reference input signal for controlling a moving speed of said actuators, and maximum dischargeable oil amount signal of said pumps;

(2) determining a sum of necessary oil amounts of said pumps required for the moving of said actuators, and calculating required discharge oil amounts to be supplied to the left-hand side of the pump and the right-hand side of the pump by the same amount respectively;

(3) determining required discharge oil amounts of the left-hand and the right-hand sides of the pumps according to said required discharge oil amounts of said second step and maximum dischargeable oil amounts of the left-hand and the right-hand sides of the pumps;

(4) determining a necessary discharge oil amount required for the moving of said actuators according to a sum of said second step and maximum dischargeable oil amounts of said pumps; and (5) generating a third reference input signal for controlling the oil amount of said pumps and a fourth reference input signal for controlling the moving speed of said actuators according to said required discharge oil amounts of said fourth step; and (6) controlling the oil amount of said pumps and the moving speed of said actuators by means of the third and fourth reference input signals generated in said fifth step being applied to said proportion valves.

5. The method of claim 4, wherein said third step comprising the steps of:

(1) comparing the required discharge oil amount of the left-hand side of the pump with the maximum dischargeable oil amount of the left-hand side of the pump;

(2) setting said required discharge oil amount to be said maximum dischargeable oil amount when said required discharge oil amount is larger than said maximum dischargeable oil amount by the comparison of the first step, and adding the difference between said required discharge oil amount and said maximum dischargeable oil amount to the required discharge oil amount of the right-hand side of the pump;

(3) comparing the required discharge oil amount of the right-hand side of the pump with the maximum dischargeable oil amount of the right-hand side of the pump when the required dischage oil amount of the left-hand side of the pump is smaller than the maximum dischargeable oil amount of the left-hand side of the pump; and (4) setting said required discharge oil amount to be said maximum dischargeable oil amount when said required discharge oil amount is larger than said maximum dischargeable oil amount by the comparison of the third step, and adding the difference between said required discharge oil amount and said maximum dischargeable oil amount to the required discharge oil amount of the left-hand side of the pump.

6. A method for controlling actuators of hydraulic construction equipment, said actuators supplied with oil from pumps through electrically controllable proportion valves, each pump defined as having left and right hand sides, said method comprising the steps of:

(1) calculating a necessary discharge oil amount required for the moving of actuators moved in a combination way according to a first reference input signal for controlling an oil amount of pumps with a left-hand and right-hand sides, a second reference input signal for controlling a moving speed of said actuators, and maximum dischargeable oil amount signal of said pumps;

(2) detecting an adding-up condition of whether or not the oil amounts discharged from said pumps are combined and supplied to any one of said actuators;

(3) determining a sum of necessary oil amounts of said pumps required for the moving of said actuators, and calculating required discharge oil amounts to be supplied to the left-hand side of the pump and the right-hand side of the pump by the same amount respectively;

(4) determining required discharge oil amounts of said pumps according to said required discharge oil amounts of the third step and maximum dischargeable oil amounts of the left-hand side pump and the right-hand side pump;

(5) determining necessary oil amounts required for the moving of said actuators according to the sum of the third step and said maximum dischargeable oil amounts of said pumps;

(6) generating a reference input signal for controlling the oil amount of said pumps and another reference input signal for controlling the moving speed of said actuators according to said required discharge oil amounts of said fifth step;

(7) determining the required discharge oil amount of the left-hand side of the pump to be a sum of necessary oil amount of the left-hand side of the pump when said adding up condition of said second step is not satisfied, and calculating required discharge oil amount of the left-hand side of the pump according to said required discharge oil amount of the left-hand side of the pump and a maximum dischargeable oil amount of the left-hand side of the pump;

(8) determining the required discharge oil amount of the right-hand side of the pump to be a sum of necessary oil amount of the right-hand side of the pump, and calculating required discharge oil amount of the right-hand side of the pump according to said required discharge oil amount of the right-hand side of the pump and a maximum dischargeable oil amount of the right-hand side of the pump;

(9) generating a third reference input signal for controlling the oil amount of said pumps and a fourth reference input signal for controlling the moving speed of said actuators according to said required discharge oil amounts of the seventh and eighth steps; and

(10) controlling the oil amount of said pumps and the moving speed of said actuators by means of the third and fourth input signals generated in said ninth step being applied to said proportion valves.

7. The method of claim 6, wherein said third step comprising the steps of:

(1) comparing the required discharge oil amount of the left-hand side of the pump with the maximum dischargeable oil amount of the left-hand side of the pump;

(2) setting said required discharge oil amount to be said maximum dischargeable oil amount when said required discharge oil amount is larger than said maximum dischargeable oil amount by the comparison of the first step, and adding the difference between said required discharge oil amount and said maximum dischargeable oil amount to the required discharge oil amount of the right-hand side of the pump;

(3) comparing the required discharge oil amount of the right-hand side of the pump with the maximum dischargeable oil amount of the right-hand side of the pump when the required discharge oil amount of the left-hand side of the pump is smaller than the maximum dischargeable oil amount of the left-hand side of the pump; and (4) setting said required discharge oil amount to be said maximum dischargeable oil amount when said required discharge oil amount is larger than said maximum dischargeable oil amount by the comparison of the third step, and adding the difference between said required discharge oil amount and said maximum dischargeable oil amount to the required discharge oil amount of the left-hand side of the pump.

8. The method of claim 6, wherein said seventh step comprising the steps of:

(1) comparing a required discharge oil amount of the left-hand side of the pump with a maximum dischargeable oil amount of the left-hand side of the pump; and (2) setting said required discharge oil amount to be said maximum dischargeable oil amount when said required discharge oil amount is larger than said maximum dischargeable oil amount.

9. The method of claim 6, wherein said eightth step comprising the steps of:

(1) comparing a required discharge oil amount of the right-hand side of the pump with a maximum dischargeable oil amount of the right-hand side of the pump; and (2) setting said required discharge oil amount to be said maximum dischargeable oil amount when said required discharge oil amount is larger then said maximum dischargeable oil amount.

10. An apparatus for controlling actuators of hydraulic construction equipment, comprising:

means for receiving an operation command from an input portion and converting said operation command into an operation signal;

means for calculating a required discharge oil amount of a pump which is proportional to said operation signal and a required moving speed of an actuator which is proportional to the degree of operation and the operation ratio of said operation signal;

means for adjusting said required discharge oil amount and said required moving speed based on a maximum dischargeable oil amount of said pump:

first means for subtracting a real discharge oil amount from said adjusted discharge oil amount and generating a first control signal thereof and second means for subtracting a real moving speed from said adjusted moving speed and generating a second control signal thereof;

first means for controlling the discharge oil amount of said pump according to the first control signal from said first subtracting means; and second means for controlling the moving speed of said actuator according to the second control signal from said second subtracting means.

* * * * *